US008272590B2

(12) United States Patent
Izumida et al.

(10) Patent No.: US 8,272,590 B2
(45) Date of Patent: Sep. 25, 2012

(54) TAPE WINDING APPARATUS

(75) Inventors: Takahisa Izumida, Odawara (JP); Hiroki Ohtsu, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 606 days.

(21) Appl. No.: 12/406,389

(22) Filed: Mar. 18, 2009

(65) Prior Publication Data

US 2009/0236463 A1 Sep. 24, 2009

(30) Foreign Application Priority Data

Mar. 24, 2008 (JP) ..... 2008-075548

(51) Int. Cl.
*B56H 18/26* (2006.01)

(52) U.S. Cl. ..... 242/547; 242/548.2; 242/548.3

(58) Field of Classification Search ..... 242/547, 242/548, 548.2, 548.3, 615.2, 541.4–541.7, 242/346.2

See application file for complete search history.

(56) References Cited

U.S. PATENT DOCUMENTS 4,778,119 A * 10/1988 Yamazaki et al. ..... 242/548.2
5,533,690 A * 7/1996 Kline et al. ..... 242/547

FOREIGN PATENT DOCUMENTS

JP 62-031645 A 2/1987
JP 63-17155 U 2/1988
JP 06-061852 U 9/1994
JP 07-296556 A 11/1995
JP 2004-250131 A 9/2004
JP 2005-162440 A 6/2005

OTHER PUBLICATIONS

Notification of Reasons for Refusal, dated Jan. 31, 2012, issued in corresponding JP Application No. 2008-075548, 7 ages in English and Japanese.

* cited by examiner

*Primary Examiner* — Michael Mansen
*Assistant Examiner* — Juan Campos, Jr.
(74) *Attorney, Agent, or Firm* — Sughrue Mion, PLLC

(57) ABSTRACT

A tape winding apparatus includes: a rotating device configured to rotate a wind-up core for winding a tape into a roll which defines a tape roll; a push roller configured to be pressed against the tape roll, the push roller contacting with and rolling on an outer periphery of the tape roll at a tape feeding position where the tape is fed onto the tape roll; a feeding direction control guide arranged upstream from the push roller as viewed in a running direction of the tape and configured to control a tape-feeding direction of the tape that is fed onto the tape roll; and a movement device configured to move at least one of the push roller and the feeding direction control guide such that the tape-feeding direction conforms with a tangential direction of the tape roll at the tape feeding position.

1 Claim, 5 Drawing Sheets

CONTROLLER
TO CONTROLLER
TR
MT
G
P
O
L1
θ

TAPE WINDING APPARATUS

CROSS REFERENCE TO RELATED APPLICATION

This application claims the foreign priority benefit under Title 35, United States Code, §119(a)-(d) of Japanese Patent Application No. 2008-075548 filed on Mar. 24, 2008 in the Japan Patent Office, the disclosure of which is herein incorporated by reference in its entirety.

BACKGROUND OF THE INVENTION

The present invention relates to a tape winding apparatus, and more particularly to a tape winding apparatus which can wind a tape into a roll at high speeds while maintaining a precise and aligned winding profile.

It is desirable that a tape-like material such as a magnetic tape is wound into a roll with a precise and aligned winding profile. Recently, data is recorded on a magnetic tape having an extremely narrow track width. Therefore, if the tape edge is not aligned precisely when it is wound into a roll, there is a possibility that the magnetic head will not follow a predetermined track during the recording and/or reading of the data. Further, in a recent magnetic tape, a tracking servo signal is recorded on a recording layer during the manufacture of the magnetic tape. However, if the winding profile of the tape roll is not precisely aligned before recording the servo signal, the magnetic tape will shift in a direction of the tape width so that a precise recording of the servo signal cannot be performed. Moreover, if the winding profile of the magnetic tape is not aligned, the magnetic tape is partly subject to deformation and/or the tape edge is susceptible to damage. These are more likely to occur for a recent magnetic tape because the thickness of the magnetic tape becomes thinner.

The magnetic tape will be wound into a roll with a precise and aligned winding profile if the wind-up speed is reduced. However, in order to improve productivity at a production site or to improve data scan speed on a magnetic tape drive, it is desirable that the magnetic tape be wound up as fast as possible.

There is also a need to improve productivity of tape products other than magnetic tape.

Japanese Laid-open Patent Publication No. 62-31645, which corresponds to U.S. Pat. No. 4,778,119, discloses a magnetic tape wind-up system for winding up a magnetic tape into a roll shape at high speeds. In this conventional system, a push roller (i.e., edge control roller) is pressed against a tape roll that is a tape having been wound into a roll so that air between the tape roll and a magnetic tape to be wound around the tape roll is removed. This can improve preciseness and alignment of the winding profile. The push roller is supported on a swing arm, to which a position control roller is also provided to control a feed direction of the magnetic tape to the tape roll.

However, because the magnetic tape is wound around the push roller in the conventional magnetic tape wind-up system, the tensile force acting on the magnetic tape urges the push roller away from the tape roll. Therefore, as the wind-up speed is increased, a variation in the tensile force of the magnetic tape adversely affects the pressing force of the push roller, so that it becomes difficult to wind up the magnetic tape into a roll in a precise and aligned manner.

In view of the above, the present invention seeks to provide a tape winding apparatus which can wind a tape at high speeds in a precise and aligned manner while eliminating an adverse effect on the push roller due to variation in the tensile force of the tape.

SUMMARY OF THE INVENTION

According to the present invention, there is provided a tape winding apparatus comprising: a rotating device configured to rotate a wind-up core for winding a tape into a roll which defines a tape roll; a push roller configured to be pressed against the tape roll, the push roller contacting with and rolling on an outer periphery of the tape roll at a tape feeding position where the tape is fed onto the tape roll; a feeding direction control guide arranged upstream from the push roller as viewed in a running direction of the tape and configured to control a tape-feeding direction of the tape that is fed onto the tape roll; and a movement device configured to move at least one of the push roller and the feeding direction control guide such that the tape-feeding direction conforms with a tangential direction of the tape roll at the tape feeding position.

With this configuration of the tape winding apparatus according to the present invention, the push roller contacts with the tape roll at the tape feeding position where the tape is fed onto the tape roll, and the feeding direction of the tape toward the push roller is controlled by the feeding direction control guide and the movement device. This feeding direction of the tape conforms with the tangential direction of the tape roll at the tape feeding position, so that the tape is not wound around the push roller. This can eliminate an adverse effect on the pressing force of the push roller against the tape roll caused by the tensile force of the tape per se and variation in the tensile force. Therefore, shifting of the push roller is restricted, and the tape can be wound into a roll at high speeds while maintaining a precise and aligned winding profile.

In the aforementioned tape winding apparatus, the feeding direction control guide may have a cylindrical guide surface for guiding the tape. Further, the push roller may be supported on a swing arm which is swingable about a central axis of the cylindrical guide surface of the feeding direction control guide, and an urging member is further provided to urge the push roller supported on the swing arm toward the tape roll.

With this configuration of the tape winding apparatus, because the swing arm is swingable about the central axis of the cylindrical guide surface of the feeding direction control guide, the tensile force acting on the tape that is wound around the feeding direction control guide does not cause a swinging motion of the swing arm.

To be more specific, as in the case of the conventional system, if the feeding direction control guide (corresponding to the position control roller disclosed in U.S. Pat. No. 4,778,119) is supported on a swingable part of the swing arm, the tensile force acting on the tape that is wound around the feeding direction control guide will cause the swing arm to swing about its pivot axis. On the contrary, according to the above configuration of the present invention, the feeding direction control guide has a cylindrical guide surface for guiding the tape, and the rotation axis of the cylindrical guide surface conforms with the pivot axis of the swing arm. Therefore, a predetermined relative position is kept between the feeding direction control guide and the swing arm, and the tensile force of the tape does not cause a swinging motion of the swing arm.

In one specific embodiment, the movement device may comprise: a swing arm supporting the push roller and configured to be swingable about a central axis of the cylindrical guide surface of the feeding direction control guide; a slide stage on which the swing arm is swingably supported while supporting the feeding direction control guide; a spring configured to apply a pressing force to the push roller, one end of the spring being engaged with the swing arm and the other end of the spring being engaged with the slide stage; a rail along which the slide stage is guided; and an actuator for moving the slide stage along the rail.

In another specific embodiment, the movement device may comprise: a swing arm supporting the push roller and configured to be swingable about a central axis of the cylindrical guide surface of the feeding direction control guide; a first longitudinal swing arm member on which the swing arm is swingably supported; a spring configured to apply a pressing force to the push roller, one end of the spring being engaged with the swing arm and the other end of the spring being engaged with the first longitudinal swing arm member; and an actuator for swinging the first longitudinal swing arm member. In this specific embodiment, the tape winding apparatus may further comprise an optical sensor for sensing an outer diameter of the tape roll, and a controller configured to receive a detection signal from the optical sensor, and the controller may control the actuator so as to swing the first longitudinal swing arm member in accordance with the detection signal from the optical sensor.

In yet another specific embodiment, the feeding direction control guide may be fixed to a base so as not to be movable relative to the wind-up core, and the movement device may comprises a second longitudinal swing arm member supporting the push roller, and a spring configured to apply a swinging force to the second longitudinal swing arm member. In this tape winding apparatus, a pivot axis of the second longitudinal swing arm member is positioned at a midpoint of a line segment connecting a rotation axis of the wind-up core and a tape contacting point of the feeding direction control guide at which point the tape contacts with a guide surface of the feeding direction control guide for guiding the tape toward the tape roll.

According to the present invention, the tape winding apparatus can wind a tape at high speeds into a roll with a precise and aligned winding profile because the tensile force of the tape does not adversely affect on the pressing force of the push roller.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 2A and 2B explain the operation of the tape winding apparatus according to the first embodiment, in which FIG. 2A shows that a small amount of magnetic tape has been wound into a roll, and FIG. 2B shows that a large amount of magnetic tape has been wound into a roll;

FIGS. 3A and 3B show a first modification of the tape winding apparatus, in which FIG. 3A shows that a small amount of magnetic tape has been wound into a roll, and FIG. 3B shows that a large amount of magnetic tape has been wound into a roll;

FIGS. 4A and 4B show a second modification of the tape winding apparatus, in which FIG. 4A shows that a small amount of magnetic tape has been wound into a roll, and FIG. 4B shows that a large amount of magnetic tape has been wound into a roll.

DETAILED DESCRIPTION OF THE INVENTION

With reference to the accompanying drawings, preferred embodiments of the present invention will be described.

Figures 1A, 1B:
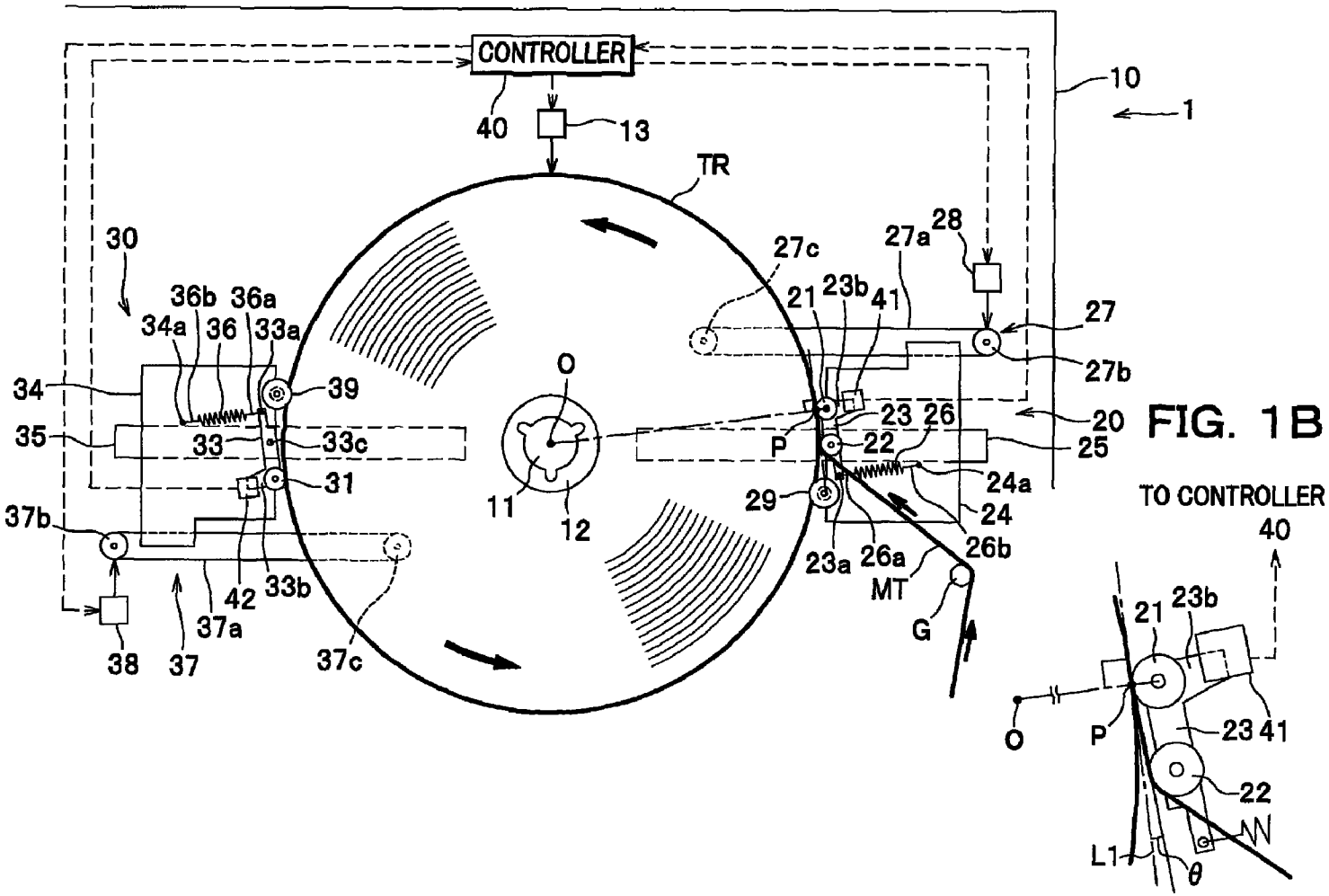
FIG. 1A shows a structure of a tape winding apparatus according to a first embodiment of the present invention.
FIG. 1B is an enlarged view showing a tape feeding position at which a magnetic tape is fed onto a tape roll.

As seen in FIG. 1A, a tape winding apparatus 1 according to a first embodiment is shown as a winding mechanism of a tape-running apparatus provided in a servo writer for recording a servo signal on a magnetic tape.

The tape winding apparatus 1 has a base 10 made of a metal plate or the like, and various devices are arranged on the base 10. The tape winding apparatus 1 mainly includes a spindle 11, a feeding-side push roller mechanism 20, an air removal push roller mechanism 30, optical sensors 41, 42, and a controller 40.

A wind-up core 12 is attached to the spindle 11. The spindle 11 is driven to rotate by a motor 13 as an example of a rotating device, so that a magnetic tape MT as an example of a tape is wound around the wind-up core 12. The rotation of the motor 13 is controlled by the controller 40.

The feeding-side push roller mechanism 20 includes a push roller 21, a feeding direction control guide 22, a swing arm 23, a slide stage 24, a rail 25, a spring 26, a drive belt member 27, a motor 28, and an edge control guide 29. The swing arm 23, the slide stage 24, the rail 25, the drive belt member 27, and the motor 28 constitute a movement device in this embodiment.

The push roller 21 is a roller made of urethane rubber and rotatably supported on the swing arm 23. The outer peripheral surface of the push roller 21 contacts with an outer periphery of a tape roll TR at a position where the magnetic tape MT is fed onto the tape roll TR (hereinafter referred to as a "tape feeding position P"), so that the push roller 21 rolls on the tape roll TR. Air between the tape roll TR and the magnetic tape MT to be fed onto the tape roll TR is gradually removed by the pressing force of the push roller 21. The push roller 21 roughly positions the edges of the magnetic tape MT to be wound around the tape roll TR.

It is preferable that the push roller 21 has a hardness of 60 or less (Hs: in compliance with JIS K 6253). In the case where the push roller 21 is made of urethane rubber, the hardness of 40 or more is preferable in order to prevent the push roller 21 from adhering to the magnetic tape MT. The hardness of the push roller 21 can be selected such that the lower it is, the more gradually air between the outermost magnetic tape MT and the tape roll TR inside this magnetic tape MT is removed, and therefore enabling the magnetic tape MT to be wound into a roll with a precise and aligned winding profile.

Further, the diameter of the push roller 21 is preferably in the range of 20-30 mm, and most preferably 28 mm. The pressing force of the push roller 21 against the tape roll TR is preferably in the range of 2.5-4 N, and most preferably 3 N.

The feeding direction control guide 22 is a roller for controlling the feeding direction of the magnetic tape MT that is fed between the push roller 21 and the tape roll TR. The feeding direction control guide 22 is a tape guide roller arranged upstream from the push roller 21 as viewed in a running direction of the magnetic tape MT. The feeding direction control guide 22 is positioned most closely to the push roller 21 at the tape feeding position P. The feeding direction control guide 22 is rotatably supported on the slide stage 24.

As seen in FIG. 1B, the controller 40 performs a control such that the angle θ defined by line L1 normal to the line segment connecting the center O of the tape roll TR and the tape feeding position P and the magnetic tape MT that is about to be fed into the tape feeding position P becomes as close to 0 degrees as possible. This angle θ is preferably in the range of −5 to 5 degrees, and more preferably in the range of −5 to 0 degrees. If this angle θ is smaller than 0 degrees, that is, if the magnetic tape MT is fed into the tape feeding position P so as not to be wound around the push roller 21, the tensile force of the magnetic tape MT does not act on the pressing force of the push roller 21.

The swing arm 23 is swingably supported on the slide stage 24 such that the pivot axis of the swing arm 23 is coaxial with the rotation axis of the feeding direction control guide 22. To be more specific, the pivot axis of the swing arm 23 is coaxial with the central axis of a cylinder which is defined by a guide surface of the feeding direction control guide 22 for guiding the magnetic tape MT. This can ensure that even if the swing arm 23 swings, it is possible to keep a predetermined relative position between the guide surface (cylindrical surface) of the feeding direction control guide 22 and the push roller 21 supported on the swing arm 23.

The swing arm 23 has one end portion opposite to the push roller 21, and the feeding direction control guide 22 is positioned between the push roller 21 and this end portion. A spring engagement portion 23*a* is formed in this end portion so that one end 26*a* of the spring 26 is hooked in the spring engagement portion 23*a*. The other end 26*b* of the spring 26 is hooked in a spring engagement portion 24*a* formed in the slide stage 24. Because the spring 26 functions as a tension spring, the swing arm 23 is urged in the anticlockwise direction of FIGS. 1A and 1B. Therefore, the outer peripheral surface of the push roller 21 is pressed against the outer periphery of the tape roll TR by the action of the spring 26.

The other end portion of the swing arm 23 is provided with the push roller 21, and a detection strip 23*b* extends from the other end portion in the direction away from the tape roll TR. The detection strip 23*b* is a part for blocking light emitted from the optical sensor 41 to be described later.

The slide stage 24 supports the feeding direction control guide 22, the swing arm 23, and the edge control guide 29. The slide stage 24 is slidable along the rail 25 in the horizontal direction of FIG. 1A. In other words, the slide stage 24 can slide along the rail 25 toward and away from the tape roll TR.

The rail 25 extends in the horizontal direction of FIG. 1A. The rail 25 guides the slide stage 24 and allows the slide stage 24 to move in parallel with the rail 25.

The drive belt member 27 constitutes a mechanism for moving the slide stage 24 in the horizontal direction of FIG. 1A. The drive belt member 27 includes a belt 27*a*, a drive pulley 27*b*, and a driven pulley 27*c*. The belt 27*a* is looped around the drive pulley 27*b* and the driven pulley 27*c* which are arranged in the horizontal direction of FIG. 1A. In other words, the belt 27*a* extends in the horizontal direction with a tension being applied to the belt 27*a* between the pulleys 27*b*, 27*c*, and upper and lower tensed portions are formed between the pulleys 27*b*, 27*c*. The slide stage 24 is fixed to the belt 27*a* at the lower tensed portion of the belt 27*a*.

A rotary driving force of the motor 28 is input to the drive pulley 27*b*. When the motor 28 is driven to rotate and the drive belt 27 turns, the slide stage 24 moves in the horizontal direction toward and away from the tape roll TR. A stepping motor or a DC motor may be employed as the motor 28.

The edge control guide 29 is a flanged roller. The edge control guide 29 is rotatably supported on the slide stage 24. The edge control guide 29 is arranged at a position adjacent to the outer periphery of the tape roll TR and at a lower side of the feeding direction control guide 22 as seen in FIG. 1A. To be more specific, the edge control guide 29 is arranged at a position where the magnetic tape MT wound around the outermost periphery of the tape roll TR is ready to enter the tape feeding position P just before passing through the feeding direction control guide 22.

The edge control guide 29 guides the tape roll TR such that only the flange portion thereof comes into contact with the both side edges of the tape roll TR while the roller portion thereof does not contact with the outer periphery of the tape roll TR. Therefore, the flange portion of the edge control guide 29 aligns the side edges of the magnetic tape MT that is positioned at and closely to the outer periphery of the tape roll TR without pressing the tape roll TR.

The optical sensor 41 has a light emitting portion (not shown) and a light receiving portion for receiving light emitted from the light emitting portion. The detection strip 23*b* enters a region between the light emitting portion and the light receiving portion, and the orientation of the swing arm 23 is detected based on the amount of light blocked by the detection strip 23*b*. The detection signal from the optical sensor 41 is output to the controller 40.

The air removal push roller mechanism 30 is positioned on the opposite side of the tape roll TR from the feeding side push roller mechanism 20. The air removal push roller mechanism 30 includes a push roller 31, a swing arm 33, a slide stage 34, a rail 35, a spring 36, a drive belt member 37, a motor 38, and an edge control guide 39.

The push roller 31 is a roller made of urethane rubber that is the same material as that of the push roller 21, and rotatably supported on the swing arm 33. The outer peripheral surface of the push roller 31 contacts with the outer periphery of the tape roll TR, so that the push roller 31 rolls on the tape roll TR. Air between the magnetic tape MT positioned at the outermost periphery of the tape roll TR and the tape roll TR inside the outermost magnetic tape MT is removed by the pressing force of the push roller 31, so that the magnetic tape MT can be securely positioned at the outermost periphery of the tape roll TR.

The swing arm 33 is swingably supported on the slide stage 34. The swing arm 33 has one end portion opposite to the push roller 31, and the pivot axis 33*c* of the swing arm 33 is positioned between the push roller 31 and this end portion. A spring engagement portion 33*a* is formed in this end portion so that one end 36*a* of the spring 36 is hooked in the spring engagement portion 33*a*. The other end 36*b* of the spring 36 is hooked in a spring engagement portion 34*a* formed in the slide stage 34. Because the spring 36 functions as a tension spring, the swing arm 33 is urged in the anticlockwise direction of FIG. 1A. Therefore, the outer peripheral surface of the push roller 31 is pressed against the outer periphery of the tape roll TR by the action of the spring 36.

The other end portion of the swing arm 33 is provided with the push roller 31, and a detection strip 33*b* extends from the other end portion in the direction away from the tape roll TR. The detection strip 33*b* is a part for blocking light emitted from the optical sensor 42 to be described later.

The slide stage 34 supports the swing arm 33 and the edge control guide 39. The slide stage 34 is slidable along the rail 35 in the horizontal direction of FIG. 1A. In other words, the slide stage 34 can slide along the rail 35 toward and away from the tape roll TR.

The rail 35 extends in the horizontal direction of FIG. 1A. The rail 35 guides the slide stage 34 and allows the slide stage 34 to move in parallel with the rail 35.

The drive belt member 37 constitutes a mechanism for moving the slide stage 34 in the horizontal direction of FIG. 1A. The drive belt member 37 includes a belt 37*a*, a drive pulley 37*b*, and a driven pulley 37*c*. The belt 37*a* is looped around the drive pulley 37*b* and the driven pulley 37*c* which are arranged in the horizontal direction of FIG. 1A. In other words, the belt 37*a* extends in the horizontal direction with a tension being applied to the belt 37*a* between the pulleys 37*b*, 37*c*, and upper and lower tensed portions are formed between the pulleys 37*b*, 37*c*. The slide stage 34 is fixed to the belt 37*a* at the upper tensed portion of the belt 37*a*.

A rotary driving force of the motor 38 is input to the drive pulley 37*b*. When the motor 38 is driven to rotate and the drive belt 37 turns, the slide stage 34 moves in the horizontal direction toward and away from the tape roll TR.

The edge control guide 39 is a flanged roller. The edge control guide 39 is rotatably supported on the slide stage 34. Because the function of the edge control guide 39 is the same as that of the edge control guide 29 as described above, detailed description of the edge control guide 39 will be omitted.

The optical sensor 42 has the same function as the optical sensor 41 as described above. The detection strip 33*b* enters a region between the light emitting portion and the light receiving portion of the optical sensor 42, and the orientation of the swing arm 33 is detected based on the amount of light blocked by the detection strip 33*b*. The detection signal from the optical sensor 42 is output to the controller 40.

Detection signals (detection results) are input from the optical sensors 41, 42 to the controller 40. The controller 40 performs a control such that the push roller 21 and the push roller 31 move gradually and radially outward of the tape roll TR in accordance with a change in the amount of magnetic tape MT wound around the wind-up core 12. The controller 40 also controls the rotation speed of a motor for rotating the spindle 11. Further, the controller 40 inputs a signal for the tensile force of the magnetic tape MT and a servo signal to be written on the magnetic tape MT to a servo write head (not shown).

Description will be focused only to controlling the push roller 21 and the push roller 31. The controller 40 outputs drive signals to the motors 28, 38 and controls the motors 28, 38 such that the input signals from the optical sensors 41, 42 indicate predetermined constant values. These values are previously stored in a memory (not shown). For example, as the amount of magnetic tape MT wound into the tape roll TR increases, the push roller 21 rotates in the clockwise direction, so that the detection strip 23*b* blocks more amount of light emitted from the optical sensor 41. In this instance, the controller 40 causes the drive pulley 27*b* to rotate for a certain amount in the anticlockwise direction of FIG. 1A to thereby turn the belt 27*a* for a certain amount. This causes the slide stage 24 to move in a direction away from the tape roll TR. Therefore, the swing arm 23 swings in the anticlockwise direction to keep a constant orientation.

The operation of the tape winding apparatus 1 as constructed above will be described.

The magnetic tape MT supplied from a tape roll (not shown) on the magnetic tape feeding side is guided along a plurality of guide rollers G (one of which is shown in FIG. 1A) and wound into the tape roll TR on the magnetic tape wind-up side, during which the servo write head (not shown) records a servo signal on the magnetic tape MT. As seen in FIG. 1A, the magnetic tape MT runs along the guide roller G and is wound around the feeding direction control guide 22 at a downstream from the guide roller G, and then the tape-running direction of the magnetic tape MT is changed at the feeding direction control guide 22 to an upward direction of FIG. 1A so that the magnetic tape MT runs toward the tape feeding position P. During this time, the magnetic tape MT runs along the tangential direction of the tape roll TR at the tape feeding position P. The magnetic tape MT is then wound around the outer periphery of the tape roll TR at the tape feeding position P.

At the tape feeding position P the magnetic tape MT is pressed against the tape roll TR by the push roller 21, so that air between the tape roll TR and the outermost magnetic tape MT is removed to a certain extent. The magnetic tape MT that has been wound into the outermost periphery of the tape roll TR rotates in the anticlockwise direction of FIG. 1A, and after a 180 degree rotation of the tape roll TR, both edges of the magnetic tape MT are aligned with those of the tape roll TR by the flange portion of the edge control guide 39. The outermost magnetic tape MT having been aligned with the tape roll TR is pressed against the tape roll TR by the push roller 31, so that air between the magnetic tape MT positioned at the outermost periphery of the tape roll TR and the tape roll TR inside the outermost magnetic tape MT is further removed and the magnetic tape MT can be more securely and stably positioned at the outermost periphery of the tape roll TR.

Further, the outermost magnetic tape MT rotates in the anticlockwise direction on the tape roll TR by 180 degrees, and at a position just before the tape feeding position P the both side edges of the outermost magnetic tape MT are aligned with those of the tape roll TR by the edge control guide 29. Accordingly, the magnetic tape MT is wound around the tape roll TR while the width thereof is aligned with the tape roll TR.

Figure 2A:
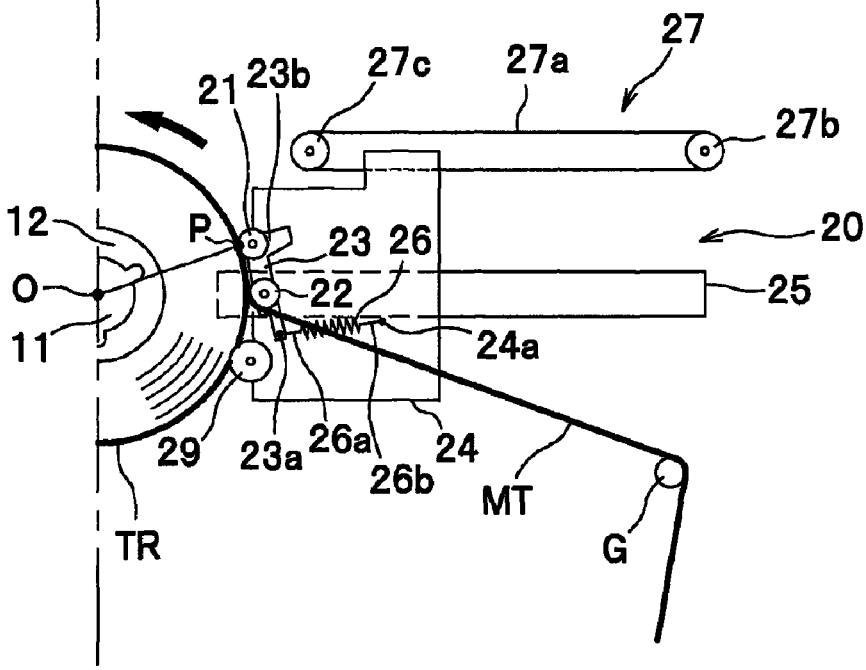
Figure 2B:
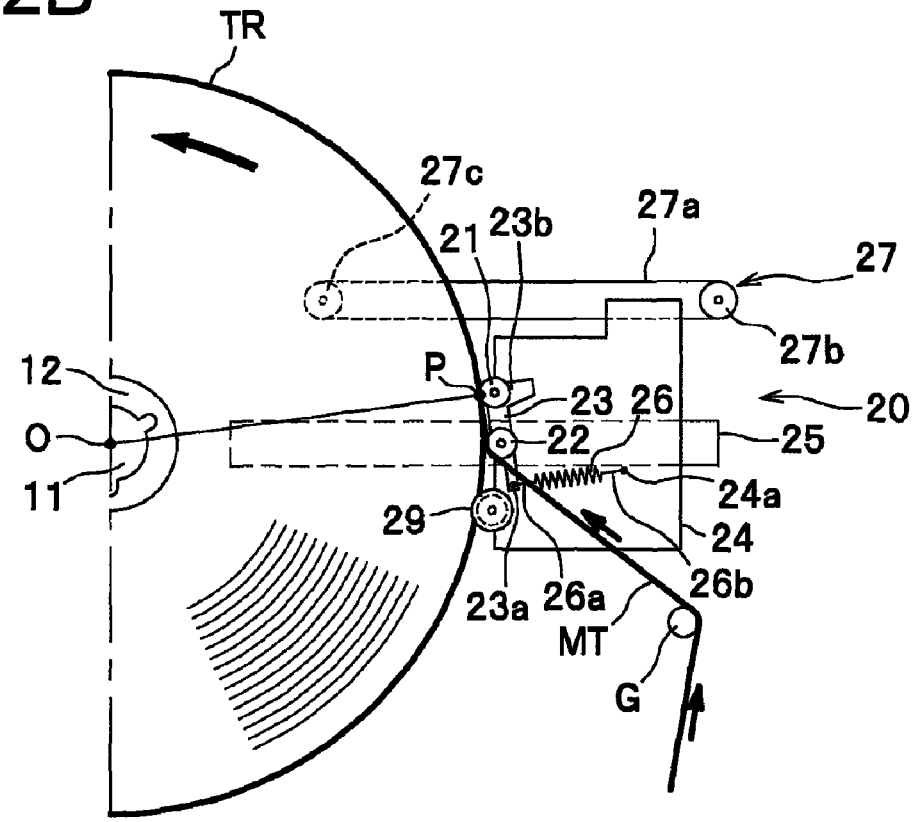

As the amount of magnetic tape MT wound into the tape roll TR increases from a small amount as shown in FIG. 2A to a large amount as shown in FIG. 2B, the push roller 21 moves radially outward of the tape roll TR, so that the amount of light emitted from the optical sensor 41 but blocked by the detection strip 23*b* changes accordingly. The controller 40 receives a signal for the amount of received light from the optical sensor 41, and controls the number of rotations of the motor 28 such that the amount of received light to be detected by the optical sensor 41 takes a constant value. Therefore, the push roller 21 moves radially outward of the tape roll TR while the swing arm 23 keeps the same orientation.

Although not shown in FIGS. 2A and 2B, as the push roller 31 moves radially outward of the tape roll TR, the amount of light emitted from the optical sensor 42 but blocked by the detection strip 33*b* changes accordingly. The controller 40 controls the number of rotations of the motor 38 such that the amount of received light to be detected by the optical sensor 42 takes a constant value. Therefore, the push roller 31 moves radially outward of the tape roll TR while the swing arm 33 keeps the same orientation.

During this wind-up process of the magnetic tape MT, as described above, the magnetic tape MT fed onto the tape roll TR is pressed against the tape roll TR by the push roller 21 at the tape feeding position P, so that air between the magnetic tape MT positioned at the outermost periphery of the tape roll TR and the tape roll TR inside the outermost magnetic tape MT is removed.

As described above, because the orientation of the swing arm 23 is constant irrespective of a change in the amount of magnetic tape MT wound into the tape roll TR, the tape-feeding direction of the magnetic tape MT running from the feeding direction control guide 22 to the tape feeding position P substantially and constantly conforms with the tangential direction of the tape roll TR at the tape feeding position P.

According to this embodiment, because the magnetic tape MT is not wound around the push roller 21, the tensile force of the magnetic tape MT per se and variation in the tensile force do not adversely affect on the push roller 21. For this reason, the pressing force of the push roller 21 applied to the outermost magnetic tape MT wound around the tape roll TR becomes stable, and therefore it is possible to wind the magnetic tape MT into a roll with a precise and aligned winding profile. Further, even if the wind-up speed for the magnetic tape MT is increased, the tensile force of the magnetic tape MT per se and variation in the tensile force do not adversely affect on the push roller 21. Therefore, it is possible to wind up the magnetic tape MT at high speeds compared to the conventional magnetic tape wind-up system.

When comparing FIG. 2A and FIG. 2B, the feeding direction control guide 22 moves outward in the horizontal direction of FIGS. 2A and 2B from the center point O of the tape roll TR. If the swing arm 23 keeps the same orientation, the magnetic tape MT running from the feeding direction control guide 22 to the tape feeding position P is slightly away from the tangential direction of the tape roll TR at the tape feeding position P. However, if this shift amount is very small, the tensile force of the magnetic tape MT does not substantially affect on the push roller 21 and no problem occurs.

In the case where the magnetic tape MT running from the feeding direction control guide 22 to the tape feeding position P is necessary to strictly conform with the tangential direction of the tape roll TR at the tape feeding position P, the outer diameter of the tape roll TR may be detected with an optical sensor, etc., and the movement of the slide stage 24 may be controlled such that the orientation of the swing arm 23 slightly changes in accordance with the outer diameter of the tape roll TR. The relation between outer diameter of the tape roll TR and position of the slide stage 24 can be stored in advance as a table.

Figure 3A:
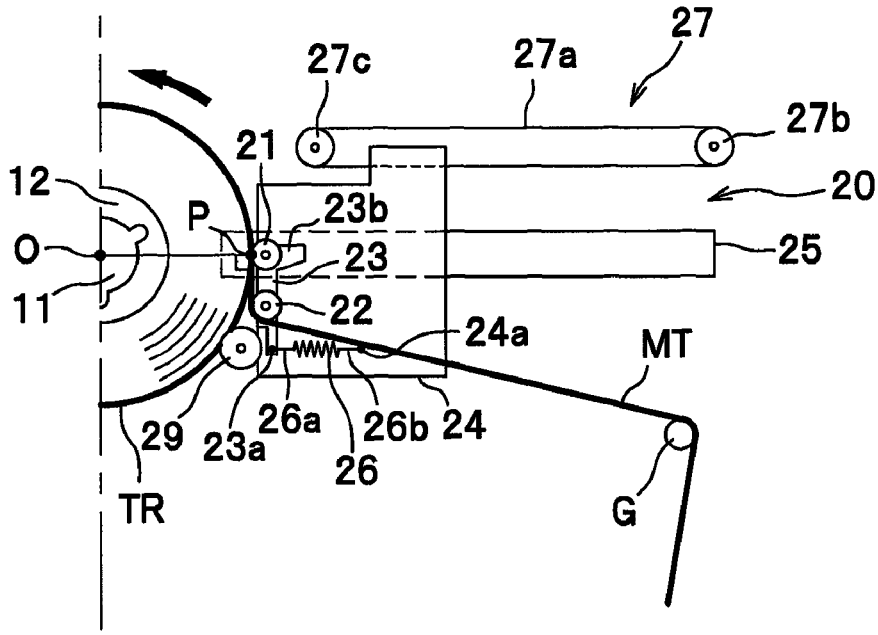
Figure 3B:
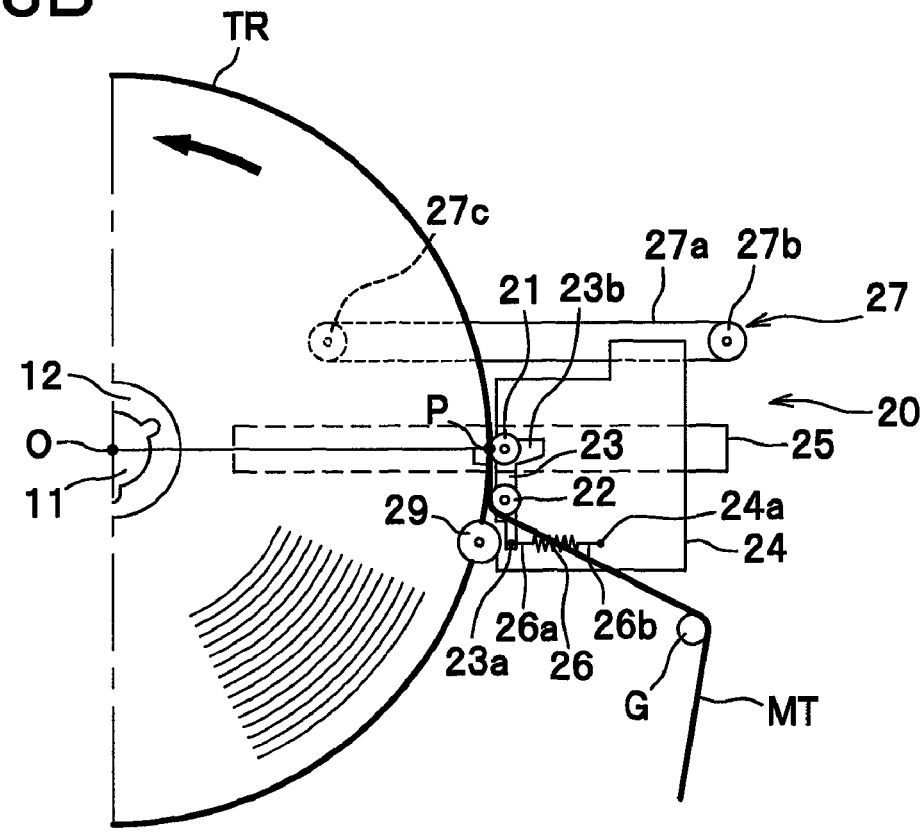

As an alternative, as seen in a modification shown in FIGS. 3A and 3B, the rail 25 and the push roller 21, etc. may be arranged such that the push roller 21 moves radially outward from the center point O of the tape roll TR along the diameter of the tape roll TR. According to this modification, the magnetic tape MT running from the feeding direction control guide 22 to the tape feeding position P can strictly conform with the tangential direction of the tape roll TR at the tape feeding position P while maintaining the constant orientation of the swing arm 23 as with the tape winding apparatus 1 shown FIG. 1A.

Although the present invention has been described in detail with reference to the above preferred embodiments, the present invention is not limited to the above specific embodiments and various changes and modifications may be made without departing from the scope of the appended claims.

Figure 4A:
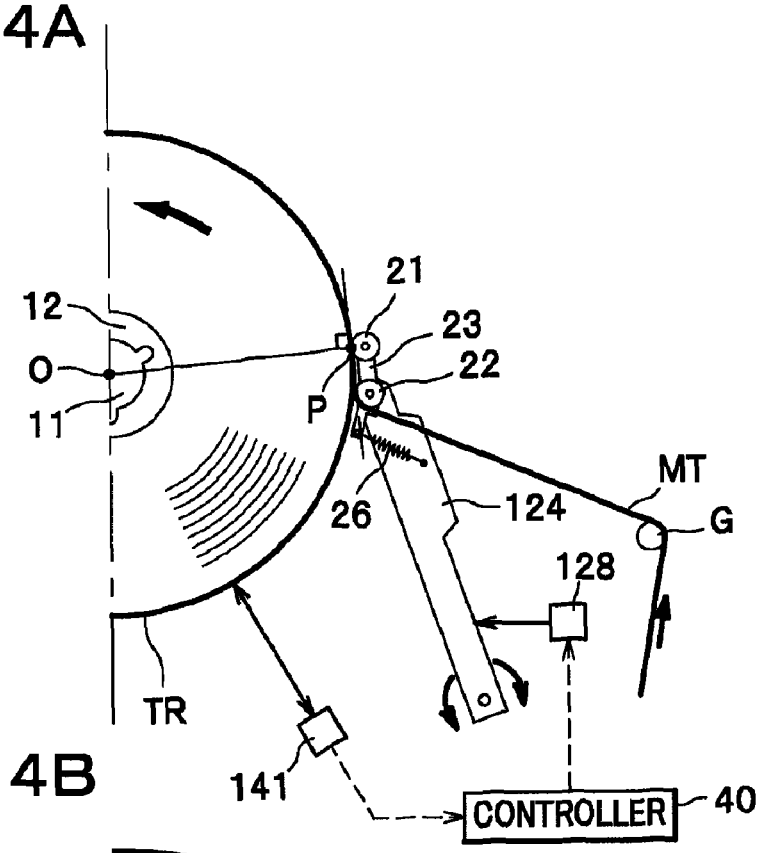
Figure 4B:
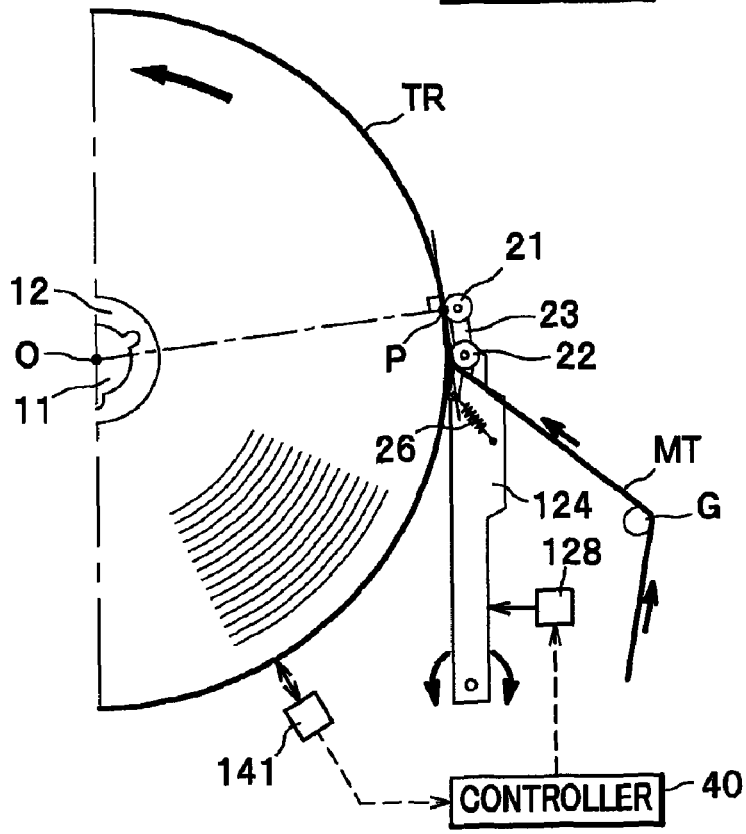

According to the above embodiments, the push roller 21 is supported by the slide stage 24 through the swing arm 23, and the slide stage 24 is moved linearly in one direction. However, the swing arm 23 for supporting the push roller 21 is not limited to this specific type. For example, as seen in FIGS. 4A and 4B, the swing arm 23 may be supported on a longitudinal swing arm member 124 which is also swingable about a pivot axis, and the orientation of the longitudinal swing arm member 124 may be controlled using an actuator 128. In this modification, the outer diameter of the tape roll TR is detected with an optical sensor 141. As seen in FIGS. 4A and 4B, the actuator 128 is controlled in accordance with the outer diameter of the tape roll TR such that the line segment OP (connecting the center O of the tape roll TR and the tape feeding position P) and the magnetic tape MT running from the feeding direction control guide 22 to the push roller 21 are always kept at a right angle irrespective of the outer diameter of the tape roll TR. Further, if the pivot axis of the swing arm 23 is coaxial with the central axis of the cylindrical guide surface of the feeding direction control guide 22, the urging force of the spring 26 applied to the push roller 21 is not subject to the tensile force of the magnetic tape MT per se and variation in the tensile force. Therefore, as with the above embodiments, a tape winding apparatus according to this modification can also wind the magnetic tape MT into a roll at high speeds while maintaining a precise and aligned winding profile.

Figure 5:
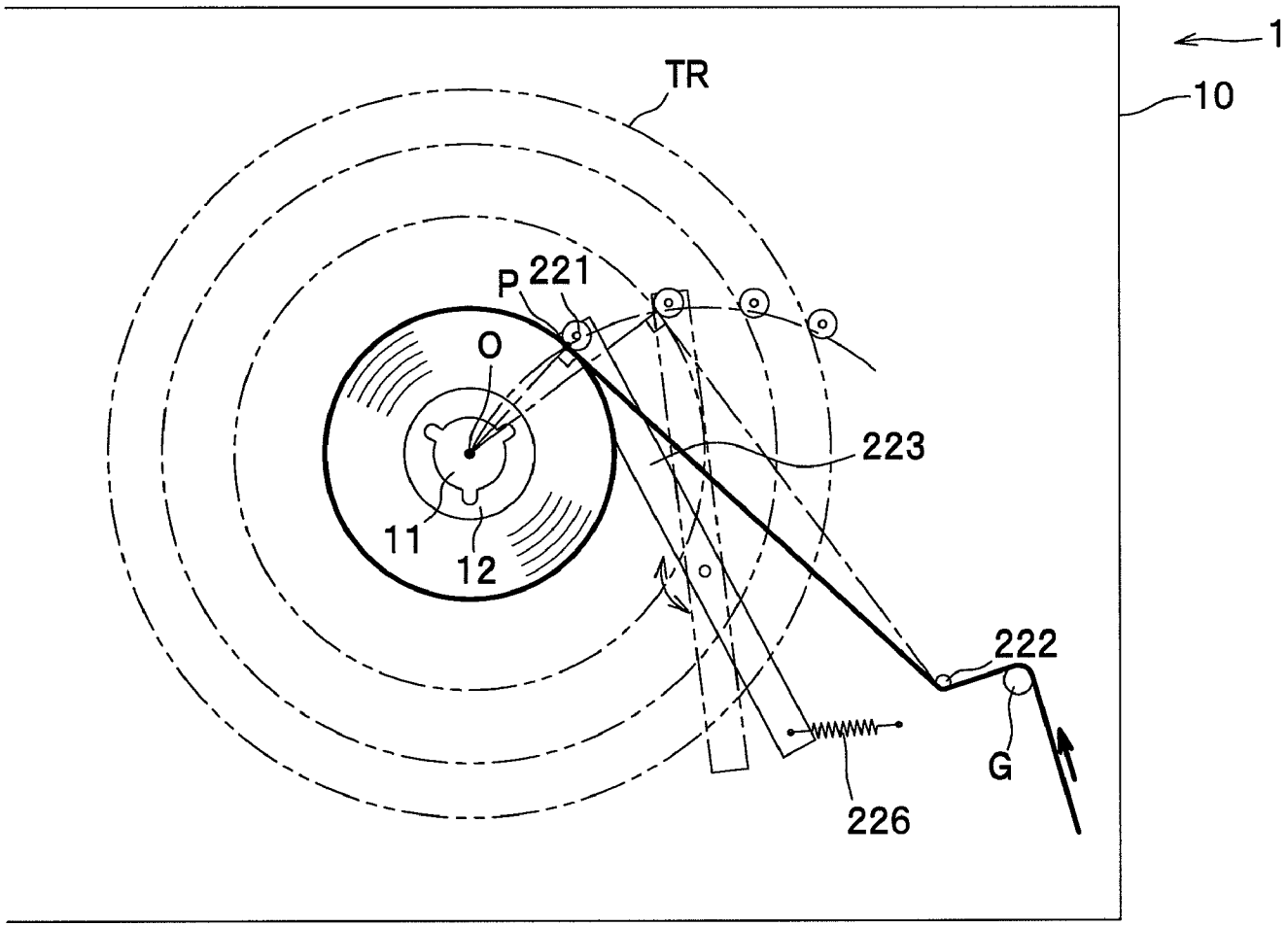
FIG. 5 shows a third modification of the tape winding apparatus.

According to another modification as seen in FIG. 5, a feeding direction control guide 222 is stationary so as not to be movable relative to the wind-up core 12. In this modification, the feeding direction control guide 222 is a non-rotatable fixed guide pin that is fixed to the base 10. As seen in FIG. 5, if the diameter of the feeding direction control guide 222 is small, a tape contacting point at which the magnetic tape MT contacts with and guided by the guide surface of the feeding direction control guide 222 may be regarded as being substantially constant. In this instance, the trajectory of the tape feeding position P in accordance with a change in the amount of magnetic tape MT wound into the tape roll TR becomes substantially a circular arc, and the center point of this circular arc is the midpoint of the line segment connecting the center point O of the tape roll TR (i.e., the rotation axis of the wind-up core 12) and the tape contacting point. According to this modification, a longitudinal swing arm member 223 is provided, and the pivot axis for this swing arm member 223 is positioned to conform with the midpoint of the line segment. Further, a push roller 221 is supported on one end portion of the longitudinal swing arm member 223 in such a position to move along the trajectory of this circular arc. A spring 226 is engaged with the other end portion of the longitudinal swing arm member 223, so that a swinging force is applied to the swing arm member 223. With this configuration of the tape winding apparatus 1, the trajectory of the tape feeding position P in accordance with a change in the amount of magnetic tape MT wound into the tape roll TR conforms with the trajectory of the push roller 221. Therefore, the advantageous effects of the present invention as described above can be obtained with a simple structure.

In the above preferred embodiments, the tape winding apparatus 1 used for a servo writer has been described. However, a tape winding apparatus according to the present invention may be applicable to other tape winding apparatus such as used for a magnetic tape drive or used in a wind-up process for adhesive tape.

Further, in the first embodiment, the feeding direction control guide 22 has been described as a roller. However, the feeding direction control guide is not limited to a roller, and may have a stationary cylindrical surface such as shown in FIG. 5. As an alternative, the feeding direction control guide may eject air so that a tape is guided without contacting with the guide surface.

EXAMPLE

Description will be give of an example, in which a tape winding apparatus according to the present invention was tested to check for its effectiveness.

A wind-up test for the magnetic tape was performed using a servo writer provided with a tape winding apparatus 1 as shown in FIG. 1A.

Conditions of the test were as follows.

| | |
|---|---|
| Thickness of the magnetic tape: | 6.6 μm |
| Pressing force of the push roller: | 3 N |
| Diameter of the push roller: | 28 mm |
| Material for the push roller: | urethane rubber |
| Hardness of the push roller: | 40 (Hs: in compliance with JIS K 6253) |

Under these conditions, the magnetic tape was wound up while changing the position of the feeding direction control guide such that the angle θ shown in FIG. 1B was defined to be −10°, −5°, 0°, 5°, and 10°, respectively. The winding profile and the wind-up state of the tape roll were checked by eye after completing the wind-up operation. The results of the test were shown in Table 1.

TABLE 1

| Angle θ | Winding Profile/ Wind-up State |
|---|---|
| −10° | Poor |
| −5° | Fair |
| 0° | Good |
| +5° | Fair |
| +10° | Poor |

As far as the results for winding profile and wind-up state are concerned, the magnetic tape came off from the tape roll due to hunting of the swing arm when the angle θ was +10 degrees. When the angle θ was +5 degrees, the magnetic tape was wound into a roll. However, the winding profile was not so good. When the pressing force of the push roller was increased from 3 N to 5N at the angle θ of +5 degrees, the winding profile (i.e., variation in the tape edge in the width direction of the magnetic tape) was improved. However, the magnetic tape was wound up so tightly that a radial pattern is formed on the tape roll as viewed from the tape edge direction. Considering all these facts, the test result was not very good at the test performed at the angle θ of +5 degrees compared with the test result at the angle θ of 0 degrees. When the angle θ was 0 degrees, the magnetic tape was wound into a roll with a precise and aligned winding profile. When the angle θ was −5 degrees, the magnetic tape was wound into a roll. However, the winding profile was slightly inferior compared with the winding profile at the angle θ of 0 degrees. When the angle θ was −10 degrees, hunting of the swing arm did not occur. However, air was not removed sufficiently, thereby leading to frequent disengagement of the magnetic tape from the tape roll.

The magnetic tape could be wound up at high speeds, such as at 16 m/s, in the range of the angle θ from −5 to 5 degrees. As disclosed in U.S. Pat. No. 4,778,119, the conventional magnetic tape wind-up system offers the maximum wind-up speed of 10 m/s (600 m/min). Therefore, a tape winding apparatus according to the present invention can offer a much faster wind-up process.

What is claimed is:

1. A tape winding apparatus comprising:

a rotating device configured to rotate a wind-up core for winding a tape into a roll which defines a tape roll;

a push roller configured to be pressed against the tape roll, the push roller contacting with and rolling on an outer periphery of the tape roll at a tape feeding position where the tape firstly contacts with the tape roll and is fed onto the tape roll;

a feeding direction control guide arranged at a non-contact position relative to the tape roll and upstream from the push roller as viewed in a running direction of the tape and configured to control a tape-feeding direction of the tape that is fed onto the tape roll, wherein the feeding direction control guide has a cylindrical guide surface for guiding the tape; and a movement device configured to move at least one of the push roller and the feeding direction control guide such that the tape-feeding direction conforms with a tangential direction of the tape roll at the tape feeding position, wherein the movement device comprises a swing arm supporting the push roller and configured to be swingable about a central axis of the cylindrical guide surface of the feeding direction control guide, a slide stage on which the swing arm is swingably supported while supporting the feeding direction control guide, a spring configured to apply a pressing force to the push roller wherein one end of the spring is engaged with the swing arm and the other end of the spring is engaged with the slide stage, a rail along which the slide stage is guided, and an actuator for moving the slide stage along the rail.

* * * * *